US010457893B2

(12) United States Patent
Ure et al.

(10) Patent No.: US 10,457,893 B2
(45) Date of Patent: Oct. 29, 2019

(54) PROCESS OF WASHING FABRICS THAT HAVE A SOFTENING ACTIVE DEPOSITED THEREON

(71) Applicant: The Procter & Gamble Company, Cincinnati, OH (US)

(72) Inventors: Colin Ure, Tyne & Wear (GB); Alan Thomas Brooker, Newcastle upon Tyne (GB); Samantha Jane Martell, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/788,997

(22) Filed: Oct. 20, 2017

(65) Prior Publication Data

US 2018/0112153 A1 Apr. 26, 2018

(30) Foreign Application Priority Data

Oct. 21, 2016 (EP) ..... 16195041

(51) Int. Cl.

| | |
|---|---|
| ***C11D 3/00*** | (2006.01) |
| ***C11D 1/831*** | (2006.01) |
| ***C11D 11/00*** | (2006.01) |
| ***C11D 17/04*** | (2006.01) |
| ***C11D 1/14*** | (2006.01) |
| ***C11D 1/72*** | (2006.01) |

(52) U.S. Cl.

CPC ..... *C11D 3/001* (2013.01); *C11D 1/831* (2013.01); *C11D 11/0017* (2013.01); *C11D 11/0064* (2013.01); *C11D 17/042* (2013.01); *C11D 1/143* (2013.01); *C11D 1/72* (2013.01)

(58) Field of Classification Search

CPC ..... C11D 3/001; C11D 1/831; C11D 1/72; C11D 1/143; C11D 17/042; C11D 11/0017

See application file for complete search history.

(56) References Cited

U.S. PATENT DOCUMENTS

| | | | | |
|---|---|---|---|---|
| 7,439,217 | B2 * | 10/2008 | Boutique | C11D 3/0015 510/276 |
| 2010/0192986 | A1 * | 8/2010 | Brooker | B65D 65/46 134/29 |
| 2016/0040099 | A1 | 2/2016 | Maes et al. | |
| 2018/0112154 | A1 | 4/2018 | Ure et al. | |

FOREIGN PATENT DOCUMENTS

| | | | | |
|---|---|---|---|---|
| WO | WO 2012/136427 | * | 10/2012 | C11D 3/386 |
| WO | WO 2012/136427 | A1 | 10/2012 | |

OTHER PUBLICATIONS

European Search Report and Written Opinion dated Apr. 24, 2017.
EP Search Report App. No. 17183783.4-1106, dated Jan. 18, 2018, 7 pages.
All Office Actions for U.S. Appl. No. 15/788,997.
All Office Actions for U.S. Appl. No. 15/789,043.
EP Search Report for App. No. 16195050.6-1358, dated Apr. 25, 2017, 7 pgs.
EP Search Report for App. No. 17184703.1-1106, dated Jan. 15, 2018, 7 pgs.
PCT Search Report for App. No. PCT/US2016/064517, dated Feb. 13, 2017, 17 pgs.
U.S. Appl. No. 15/789,043, filed Oct. 20, 2017, Colin Ure et al.
U.S. Appl. No. 14/819,462, filed Aug. 6, 2015, Jef Annie Alfons Maes.
U.S. Appl. No. 14/819,463, filed Aug. 6, 2015, Karel Jozef Maria Depoot.
U.S. Appl. No. 14/819,465, filed Aug. 6, 2015, Karel Jozef Maria Depoot.
U.S. Appl. No. 14/819,466, filed Aug. 6, 2015, Johan Maurice Theo De Poortere.
U.S. Appl. No. 15/214,489, filed Jul. 20, 2016, Karel Jozef Maria Depoot.

* cited by examiner

*Primary Examiner* — Amina S Khan
(74) *Attorney, Agent, or Firm* — Gregory S. Darley-Emerson

(57) ABSTRACT

The present disclosure relates to a process of washing fabrics where the fabrics have a softening active deposited thereon. It also relates to the use of a liquid laundry detergent composition used in the described process.

12 Claims, 1 Drawing Sheet

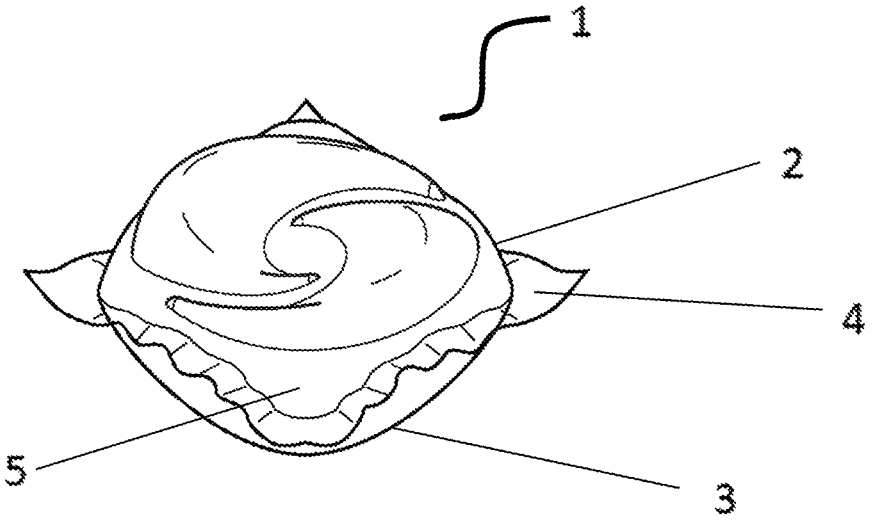
1
2
4
5
3

PROCESS OF WASHING FABRICS THAT HAVE A SOFTENING ACTIVE DEPOSITED THEREON

FIELD OF THE INVENTION

The present disclosure relates to a process of washing fabrics where the fabrics have a softening active deposited on them. It also relates to the use of a liquid laundry detergent composition used in the described process.

BACKGROUND OF THE INVENTION

Consumers prefer fabrics to be both clean and have a soft feel. However, often the fabric softening step in a wash operation is inefficient. This inefficiency could be due to softening active being washed away in the rinse step rather than depositing on fabrics, for example through complexation with anionic surfactants carried over from the main into the rinse cycle. Also, often fabric softening active that has been deposited onto fabrics during the rinse step remains on the fabric until the fabrics are due to be washed again (e.g. following wear by the consumer). However, during the wash operation there is tendency for this deposited softening active to be removed again from the fabric, for example through a stripping action by the main wash surfactant actives. This means more fabric softening active needs to be added back in the following rinse cycle to replace that part of softening active which has been lost. Overall this is inefficient as excess fabric softening active is needed to overcome the loss of softening active at various points during the wash operation, negatively impacting the consumer experience.

Therefore, there is a need in the art for a process of washing fabrics that more efficiently provides a softness benefit to said fabrics, enabling an overall reduction of fabric softener needed.

It was surprisingly found that the process according to the present disclosure overcame this technical problem.

SUMMARY OF THE INVENTION

The present disclosure relates to a process of washing a fabric, comprising the steps of:

a. Obtaining a fabric comprising a softening active deposited thereon;

b. Treating the fabric in a wash step, wherein the wash step comprises contacting the fabric with a wash liquor;

wherein the wash liquor is prepared by diluting a liquid laundry detergent composition in water by between 300 and 800 fold, preferably between 400 and 700 fold; and wherein the liquid laundry detergent composition comprises between 0% and 5%, preferably between 0% and 4%, preferably between 0.01% and 3%, more preferably between 0.02% and 2% by weight of the liquid laundry detergent of a fatty alcohol ethoxylate non-ionic surfactant; and optionally a non-soap anionic surfactant optionally a second non-ionic surfactant, wherein the second non-ionic surfactant is a surfactant other than a fatty alcohol ethoxylate non-ionic surfactant.

The present disclosure also relates to a use of a liquid laundry detergent composition described herein to improve the efficiency of softening fabrics in a wash process wherein said fabrics comprise a softening active deposited thereon.

BRIEF DESCRIPTION OF THE DRAWINGS

The FIGURE herein is illustrative in nature and is not intended to be limiting.

FIG. 1 is a water-soluble unit dose article according to the present invention.

DETAILED DESCRIPTION OF THE INVENTION

Process

The present disclosure relates to a process of washing a fabric.

The process comprises the step of;

a. Obtaining a fabric comprising a softening active deposited thereon.

The fabric to be washed may be any suitable fabric. By fabric we preferably mean a textile or cloth comprising a network of natural or artificial fibers. Those skilled in the art will be aware of suitable fabrics. The fabric may be selected from cotton, polyester, cotton/polyester blends or a mixture thereof, preferably cotton. The fabric may comprise a stain, soil or mixture thereof to be removed. Those skilled in the art will be aware of suitable stains or soils to be removed.

The fabric softening active may have been deposited on the fabric in a previous wash operation.

Those skilled in the art will be aware of suitable softening actives. The softening active in described in more detail below.

The process comprises the further step of;

b. Treating the fabric in a wash step, wherein the wash step comprises contacting the fabric with a wash liquor.

The wash liquor is prepared by diluting a liquid laundry detergent composition in water by between 300 and 800 fold, preferably between 400 and 700 fold. The liquid laundry detergent composition is described in more detail below.

The process may comprise the further step of;

c. Treating the fabric from step b in a rinse step, wherein the rinse step comprises contacting the fabric with a rinse solution.

The rinse solution is prepared by diluting a fabric softening composition in water, wherein the fabric softening composition comprises a softening active. The softening composition is described in more detail below.

The steps of the process may be conducted in an automatic washing machine, a manual wash operation or a mixture thereof, preferably an automatic washing machine. Those skilled in the art will be aware of suitable manual and automatic wash processes. Automatic wash processes are conducted in automatic washing machines.

Preferably, the wash liquor is at a temperature of between 5° C. and 90° C., preferably between 10° C. and 60° C., more preferably between 12° C. and 45° C., most preferably between 15° C. and 40° C.

Preferably, the wash step takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes to complete.

Preferably the wash liquor may comprises between 1 L and 64 L, preferably between 2 L and 32 L, more preferably between 3 L and 20 L of water.

Preferably, the wash liquor and the rinse wash liquor independently comprises between 1 kg and 20 kg, preferably between 3 kg and 15 kg, most preferably between 5 and 10 kg of fabrics.

Without wishing to be bound by theory, it is believed that the process of the present invention results in less fabric softening active that is deposited on the fabrics from being removed during the wash process. This means that the fabrics have a softer feel at the end of the wash process as compared to fabric washed in a different wash process. It is the specific combination of steps in the process including the specific choice of liquid laundry detergent composition that provides the benefit.

Liquid Laundry Detergent Composition

The liquid laundry detergent composition comprises between 0% and 5%, preferably between 0% and 4%, preferably between 0.01% and 3%, more preferably between 0.02% and 2% by weight of the liquid laundry detergent of a fatty alcohol ethoxylate non-ionic surfactant.

Suitable alcohol ethoxylate nonionic surfactants include the condensation products of aliphatic alcohols with from 1 to 25 moles of ethylene oxide. The alkyl chain of the aliphatic alcohol can either be straight or branched, guerbet, primary or secondary, and generally contains from 8 to 22 carbon atoms. The starting alcohol can be naturally derived, e.g. starting from natural oils, or synthetically derived, e.g. alcohols obtained from for example oxo-, modified oxo- or Fischer-Tropsch processes. Examples of oxo-process derived fatty alcohols include the Lial and Isalchem fatty alcohols ex Sasol company and Lutensol fatty alcohols ex BASF company. Examples of modified-oxo process derived fatty alcohols include the Neodol fatty alcohols ex Shell company. Fischer-Tropsch derived fatty alcohols include Safol fatty alcohols ex Sasol company. The alkoxylate chain of fatty alcohol ethoxylates is made up solely of ethoxylate groups.

Preferably, the fatty alcohol ethoxylate non-ionic surfactant comprises on average between 8 and 18, more preferably between 10 and 16 even more preferably between 12 and 15 carbon atoms in the alcohol carbon chain, and on average between 5 and 12, preferably between 6 and 10, more preferably between 7 and 8 ethoxy units in the ethoxylation chain.

The liquid laundry detergent composition may be comprised in a water-soluble unit dose article comprising a water-soluble film. The water-soluble unit dose article is described in more detail below.

The liquid laundry detergent composition may comprise a non-soap anionic surfactant. The liquid laundry detergent composition may comprise between 10% and 50%, preferably between 15% and 45%, more preferably between 20% and 45% even more preferably between 25% and 45%, most preferably between 30% and 45% by weight of the liquid laundry detergent composition of the non-soap anionic surfactant.

The non-soap anionic surfactant is preferably selected from linear alkylbenzene sulphonate, alkyl sulphate, alkoxylated alkyl sulphate or a mixture thereof. Preferably, the alkoxylated alkyl sulphate is an ethoxylated alkyl sulphate preferably with an average degree of ethoxylation of between 0.5 and 4, preferably between 1 and 4, more preferably between 2 and 4, most preferably about 3.

Preferably, the weight ratio of linear alkylbenzene sulphonate to alkoxylated alkyl sulphate is between 15:1 and 1:3, preferably 10:1 and 1:2, more preferably 5:1 and 1:1, even more preferably 3:1 and 1:1, most preferably 2:1 and 1:1.

The liquid laundry detergent composition may comprise a second non-ionic surfactant, wherein the second non-ionic surfactant is a surfactant other than a fatty alcohol ethoxylate non-ionic surfactant. The second non-ionic surfactant may comprise a fatty alcohol alkoxylate, an oxo-synthesised fatty alcohol alkoxylate, Guerbet alcohol alkoxylates, alkyl phenol alcohol alkoxylates, alkyl polyglucoside (APG) or a mixture thereof. Wherein the second non-ionic surfactant is an alkoxylate, such alkoxylates may for example comprise butoxylate groups, propoxylate groups or a mixture thereof in the alkoxylate chain with or without further presence of ethoxylate groups in the alkoxylate chain. Alternatively the second nonionic surfactant may be selected from alkyl polyglucoside (APG) nonionic surfactant, or alternative nonionic surfactants known by the person skilled in the art.

Preferably, the liquid laundry detergent composition comprises between 0% and 10%, preferably between 0% and 6%, more preferably between 0.01% and 5%, most preferably between 0.1% and 3% by weight of the liquid laundry detergent composition of the second non-ionic surfactant.

Preferably, the weight ratio of non-soap anionic surfactant to fatty alcohol ethoxylate non-ionic surfactant in the liquid laundry detergent composition is from 5:1 to 23:1, preferably from 1.3:1 to 15:1, more preferably from 1.5:1 to 10:1.

Preferably, the weight ratio of non-soap anionic surfactant to total non-ionic surfactant in the liquid laundry detergent composition is from 5:1 to 23:1, preferably from 1.3:1 to 15:1, more preferably from 1.5:1 to 10:1, wherein total non-ionic surfactant is the sum total of weight percentage of the fatty alcohol ethoxylate non-ionic surfactant and the second non-ionic surfactant.

Preferably, the weight ratio of linear alkylbenzene sulphonate to total non-ionic surfactant is between 2:1 to 20:1 preferably 2:1 and 10:1; more preferably 5:1 and 10:1 wherein total non-ionic surfactant is the sum total of weight percentage of the fatty alcohol ethoxylate non-ionic surfactant and the second non-ionic surfactant.

Preferably, the weight ratio of alkoxylated alkyl sulphate to total non-ionic surfactant is between 2:1 and 20:1 preferably between 2:1 and 10:1 more preferably between 2:1 and 5:1 wherein total non-ionic surfactant is the sum total of weight percentage of the fatty alcohol ethoxylate non-ionic surfactant and the second non-ionic surfactant.

Preferably, the liquid laundry detergent composition comprises between 20% and 60%, preferably between 30% and 50%, more preferably between 35% and 45% by weight of the liquid laundry detergent composition of non-soap surfactant.

Preferably, the liquid laundry detergent composition comprises between 0.5% and 15%, preferably between 1% and 13% most preferably between 1.5% and 12.5% by weight of the liquid laundry detergent composition of water.

The liquid laundry detergent composition comprises between 1% and 20%, preferably between 3% and 15%, more preferably between 5% and 10% by weight of the liquid laundry detergent composition of fatty acid, neutralised fatty acid soap or a mixture thereof.

The liquid laundry detergent composition may comprise a polymer, preferably selected from alkoxylated, preferably ethoxylated polyethyleneimine, alkoxylated polyalkyl phenol, an amphiphilic graft copolymer, a polyester terephthalate, hydroxyethylcellulose, preferably quaternized hydroxyethylcellulose, a carboxymethylcellulose or a mixture thereof.

The liquid laundry detergent composition may comprise an adjunct material, wherein the adjunct material is preferably selected from polymers, builders, dye transfer inhibiting agents, dispersants, enzyme stabilizers, catalytic materials, bleach, bleach activators, polymeric dispersing agents, anti-redeposition agents, suds suppressors, aesthetic dyes, opacifiers, perfumes, perfume delivery systems, structurants, hydrotropes, processing aids, pigments and mixtures thereof.

Water-Soluble Unit Dose Article

The water-soluble unit dose article comprises the water-soluble film shaped such that the unit-dose article comprises at least one internal compartment surrounded by the water-soluble film, and wherein the liquid laundry detergent composition is present within said compartment. The unit dose article may comprise a first water-soluble film and a second water-soluble film sealed to one another such to define the internal compartment. The water-soluble unit dose article is constructed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, a first water-soluble film may be shaped to comprise an open compartment into which the detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation, the unit dose article will comprise three films, top, middle and bottom. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments.

FIG. 1 discloses a water-soluble unit dose article (1) according to the present invention. The water-soluble unit dose article (1) comprises a first water-soluble film (2) and a second water-soluble film (3) which are sealed together at a seal region (4). The laundry detergent composition (5) is comprised within the water-soluble soluble unit dose article (1).

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Fabric Softening Composition

The process may comprise the further step of;

c. Treating the fabric from step b in a rinse step, wherein the rinse step comprises contacting the fabric with a rinse solution.

The rinse solution is prepared by diluting a fabric softening composition in water, wherein the fabric softening composition comprises a softening active.

The fabric softener composition may comprise from 2% to 25%, preferably from 3% to 20%, more preferably from 4% to 15% of a fabric softening active. The fabric softening actives are described in more detail below.

The fabric softening composition may be in any suitable form, such as liquid, solid, or a mixture thereof.

Fabric Softening Active

The softening active deposited on the fabrics and in the fabric softening composition may be the same or different. The softening active deposited on the fabric and in the fabric softening composition are independently selected from the softening actives detailed below. Preferably the softening active deposited on the fabric is selected from the same softening active as that comprised in the fabric softening composition.

The softening active may be selected from the group consisting of quaternary ammonium compounds, amines, fatty esters, sucrose esters, silicones, dispersible polyolefins, polysaccharides, fatty acids, softening oils, polymer latexes, softening clays and combinations thereof. Preferably the fabric softening active is selected from the group consisting of quaternary ammonium compounds and mixtures thereof, more preferably ester quats, most preferably the fabric softening active is selected from the group consisting of monester quats, diester quats, triester quats and combinations thereof, more preferably Diethylester Dimethyl Ammonium Chloride.

The fabric softening active may be selected from the group consisting of quaternary ammonium compounds and mixtures thereof, more preferably ester quats, even more preferably diester quats, most preferably Diethylester Dimethyl Ammonium Chloride (DEEDMAC).

Suitable quaternary ammonium compounds (quats) include but are not limited to, materials selected from the group consisting of ester quats, amide quats, imidazoline quats, alkyl quats, amidoester quats and combinations thereof. Suitable ester quats include but are not limited to, materials selected from the group consisting of monoester quats, diester quats, triester quats and combinations thereof.

Said fabric softening active may comprise compounds of the following formula:

$$\{R^2_{4-m}—N^+—[X—Y—R^1]_m\}A^-$$

wherein:

m is 1, 2 or 3 with proviso that the value of each m is identical;

each $R^1$ is independently hydrocarbyl, or substituted hydrocarbyl group;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently $(CH_2)n$, $CH_2$—$CH(CH_3)$— or CH—$(CH_3)$—$CH_2$— and each n is independently 1, 2, 3 or 4, preferably each n is 2;

each Y is independently —O-(0)C— or —C(O)—O—;

A- is independently selected from the group consisting of chloride, methylsulfate, ethylsulfate, and sulfate, preferably A- is selected from the group consisting of chloride and methyl sulfate;

with the proviso that the sum of carbons in each $R^1$, when Y is —O—(O)C—, is from 13 to 21, preferably the sum of carbons in each $R^1$, when Y is —O—(O)C—, is from 13 to 19.

Examples of suitable commercially quaternary ammonium ester fabric softening actives are available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

These types of agents and general methods of making them are disclosed in U.S. Pat. No. 4,137,180.

A second type of suitable fabric softening active has the formula:

$$[R_{4-m}—N^+—R^1_m]A^- \quad (2)$$

wherein each R, $R^1$, m and $A^-$ have the same meanings as before.

Non-limiting examples of fabric softening actives comprising formula (2) include dialkylenedimethylammonium salts such as dicanoladimethylammonium chloride, di(hard) tallowdimethylammonium chloride dicanoladimethylammonium methylsulfate, and combinations thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

Most preferably the fabric softening active is selected from the group consisting of diester quats, more preferably Diethylester Dimethyl Ammonium Chloride.

The iodine value (IV) of the parent fatty acyl compound or acid from which the alkyl or, alkenyl chains are derived is from 0 to 60, preferably from 12 to 58, more preferably from 18 to 56.

If there is any unsaturated quaternary ammonium compound present in the composition, the iodine value, referred to above, represents the mean iodine value of the parent fatty acyl compounds or fatty acids of all of the quaternary ammonium compound present.

Suitable amines include but are not limited to, materials selected from the group consisting of amidoesteramines, amidoamines, imidazoline amines, alkyl amines, and combinations thereof. Suitable ester amines include but are not limited to, materials selected from the group consisting of monoester amines, diester amines, triester amines and combinations thereof. Suitable amidoamines include but are not limited to, materials selected from the group consisting of monoamido amines, diamido amines and combinations thereof. Suitable alkyl amines include but are not limited to, materials selected from the group consisting of mono alkylamines, dialkyl amines quats, trialkyl amines, and combinations thereof.

The fabric softening active may be a fatty acid. It should be understood that the fatty acid as a softening active deposited on fabrics may be different to the fatty acid optionally added to the liquid laundry detergent composition. The term "fatty acid" is used herein in the broadest sense to include unprotonated or protonated forms of a fatty acid. One skilled in the art will readily appreciate that the pH of an aqueous composition will dictate, in part, whether a fatty acid is protonated or unprotonated. The fatty acid may be in its unprotonated, or salt form, together with a counter ion, such as, but not limited to, calcium, magnesium, sodium, potassium, and the like. The term "free fatty acid" means a fatty acid that is not bound to another chemical moiety (covalently or otherwise).

The fatty acid may include those containing from 12 to 25, from 13 to 22, or even from 16 to 20, total carbon atoms, with the fatty moiety containing from 10 to 22, from 12 to 18, or even from 14 (mid-cut) to 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc.; (3) processed and/or bodied oils, such as linseed oil or tung oil via thermal, pressure, alkali-isomerization and catalytic treatments; (4) combinations thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids.

Mixtures of fatty acids from different fat sources can be used.

The cis/trans ratio for the unsaturated fatty acids may be important, with the cis/trans ratio (of the C18:1 material) being from at least 1:1, at least 3:1, from 4:1 or even from 9:1 or higher.

Branched fatty acids such as isostearic acid are also suitable since they may be more stable with respect to oxidation and the resulting degradation of color and odor quality.

The fatty acid may have an iodine value from 0 to 140, from 50 to 120 or even from 85 to 105.

The fabric softening active may comprise a polysaccharide, such as cationic starch. Suitable cationic starches for use in the present compositions are commercially-available from Cerestar under the trade name C*BOND® and from National Starch and Chemical Company under the trade name CATO® 2A.

Softening oils include, but are not limited to, vegetable oils (such as soybean, sunflower, coconut-oil and canola), hydrocarbon based oils (natural and synthetic petroleum lubricants, in one aspect polyolefins, isoparaffins, and cyclic paraffins), triolein, caprylic/capric acid triglyceride, fatty esters (such as glycerol monostearate and glycerol distearate), fatty alcohols (such as palmityl and stearyl alcohol), fatty amines, fatty amides, and fatty ester amines.

Sucrose esters are typically derived from sucrose and fatty acids. Sucrose ester is composed of a sucrose moiety having one or more of its hydroxyl groups esterified.

Sucrose is a disaccharide having the following formula:

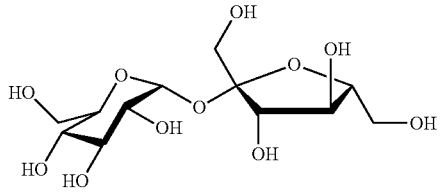

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8−x) is the hydroxyl groups that remain unchanged; x is an integer selected from 1 to 8, alternatively from 2 to 8, alternatively from 3 to 8, or from 4 to 8; and IV moieties are independently selected from $C_1$-$C_{22}$ alkyl or $C_1$-$C_{30}$ alkoxy, linear or branched, cyclic or acyclic, saturated or unsaturated, substituted or unsubstituted.

The $R^1$ moieties may comprise linear alkyl or alkoxy moieties having independently selected and varying chain length. For example, IV may comprise a mixture of linear alkyl or alkoxy moieties wherein greater than 20% of the linear chains are $C_{18}$, alternatively greater than 50% of the linear chains are C18, alternatively greater than 80% of the linear chains are C18.

The $R^1$ moieties may comprise a mixture of saturate and unsaturated alkyl or alkoxy moieties. The iodine value (IV) of the sucrose esters suitable for use herein ranges from 1 to 150, or from 2 to 100, or from 5 to 85. The IV moieties may be hydrogenated to reduce the degree of unsaturation. In the case where a higher IV is preferred, such as from 40 to 95, then oleic acid and fatty acids derived from soybean oil and canola oil are suitable starting materials.

The unsaturated $R^1$ moieties may comprise a mixture of "cis" and "trans" forms the unsaturated sites. The "cis"/"trans" ratios may range from 1:1 to 50:1, or from 2:1 to 40:1, or from 3:1 to 30:1, or from 4:1 to 20:1.

Generally, all dispersible polyolefins that provide fabric softening benefits can be used as fabric softening active in the present invention. The polyolefins can be in the form of waxes, emulsions, dispersions or suspensions.

The polyolefin may be chosen from a polyethylene, polypropylene, or combinations thereof. The polyolefin may be at least partially modified to contain various functional groups, such as carboxyl, alkylamide, sulfonic acid or amide groups. The polyolefin may be at least partially carboxyl modified or, in other words, oxidized.

Non-limiting examples of fabric softening active include dispersible polyethylene and polymer latexes. These agents can be in the form of emulsions, latexes, dispersions, suspensions, and the like. They may be in the form of an emulsion or a latex. Dispersible polyethylenes and polymer latexes can have a wide range of particle size diameters ($\chi_{50}$) including but not limited to from 1 nm to 100 μm; alternatively, from 10 nm to 10 μm. As such, the particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used as emulsifiers for polymer emulsions and latexes used as fabric softeners active in the present invention. Suitable surfactants include anionic, cationic, and nonionic surfactants, and combinations thereof. In one aspect, such surfactants are nonionic and/or anionic surfactants. In one aspect, the ratio of surfactant to polymer in the fabric softening active is 1:5, respectively.

Useful silicones can be any silicone comprising compound. The silicone polymer may be selected from the group consisting of cyclic silicones, polydimethylsiloxanes, aminosilicones, cationic silicones, silicone polyethers, silicone resins, silicone urethanes, and combinations thereof. The silicone may be a polydialkylsilicone, alternatively a polydimethyl silicone (polydimethyl siloxane or "PDMS"), or a derivative thereof. The silicone may be chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

Suitable clays include those materials classified geologically as smectites.

Use

A further aspect of the present invention is the use of a liquid laundry detergent composition described herein to improve the efficiency of softening fabrics in a wash process wherein said fabrics comprise a softening active deposited thereon.

Method of Making Liquid Laundry Detergent Composition

Those skilled in the art will know how to manufacture the water-soluble unit dose article and the liquid laundry detergent composition using common techniques known in the art.

EXAMPLES

The following fabric cleaning test was done to determine the effect of nonionic surfactant in the main wash detergent product on cotton fabric softness in the presence of liquid fabric softener.

Full Scale Cleaning Test:

Fabric Pre-Treatment Step:

Black Cotton towel swatches measuring 25 cm×25 cm were obtained from Warwick Equest Ltd (Consett Business Park, Consett DH8 6BN, United Kingdom) and washed once in a Miele W1714 front loading machine using a 60° C., short cotton wash cycle with 38 g ECE-2 Detergent (Obtainable from MRP Ltd 4 Montpelier Street (#236), London, England SW7 1EX) and 8 gpg water (40 towel swatches per load). After washing, the wash cycle was repeated two more times without added detergent. The black cotton towel swatches were then dried on a washing line Fabric Cleaning Step:

Pre-treated black cotton towel swatches were then split across two similar Miele 1714 washing machines, each machine comprising 4 pre-treated black cotton towel swatches. 25 g of the detergent product of below composition was added to each washing machine via a water soluble pouch. 2.5 g of nonionic surfactant (Neodol© E7 ex Shell plc) was added to one machine together with the water soluble detergent pouch (designated as test machine B). The remaining machine solely comprising the water soluble detergent pouch is designated as "A- reference".

Machine settings for the cleaning step were as follows:

- Miele Honeycomb Care W1714 Cycle: 40 C, 1600 RPM, 8 gpg, run time=85 minutes (short)
- Ballast=3.86 kg cotton mix (17×50% cotton/50% polyester sheets measuring 56 cm×50 cm & 12 knitted cotton sheets measuring 54 cm×50 cm);
- Soil load=2×SBL2004 sheets per run (Obtainable from MRP Ltd 4 Montpelier Street (#236), London, England SW7 1EX).

The wash cycle is repeated 5 times in total with the black towels and ballast load remaining in the wash drum throughout the process. The detergent pouch is added directly in the center of the drum under the wash load. SBL sheets were replaced at the end of each cycle and 2 fresh sheets were added. The additional nonionic surfactant is added to Machine B via a 5% aqueous solution through the powder drawer at the beginning of the wash. 25 ml of Fabric Conditioner (Lenor super concentrate, as commercially available in the UK in July 2016, comprising Diethylester Dimethyl Ammonium Chloride—DEEDMAC softening active) was added to each wash via the appropriate compartment in the washing machine dispenser drawer.

The experiment was performed in duplicate.

After line-drying (ambient room temperature and humidity) the softness of the swatches was measured by a manual panel consisting of 3 trained experts. Swatches from each test set (A or B) were compared for softness head to head using the following scale. The results were recorded as % of swatches preferred from each treatment and as the average of the paneling scores.

Expert paneling matched pair preference score:

4—Selected product is a whole lot better.

3—Selected product is a lot better.

2—Selected product is a little better.

1—I think selected product is better.

0—There is no difference between the two products.

Detergent Composition:

| Surfactants | Parts RM % in FP | |
|---|---|---|
| Nonionic-24 AO7 | 1.15 | NEODOL ™ E7 ex Shell plc |
| Linear alkyl Sulfonate(HLAS) | 12.25 | Tensaryl SBU ex Tensachem. Rue de Renory 28, B-4102 Ougree, Belgium |
| Laureth Sulfate | 9.76 | Tensagex EOC 970B, ex Tensachem. Rue de Renory 28, B-4102 Ougree, Belgium |
| Citric acid | 1.00 | |
| Topped Palm Kernel Fatty acid | 3.549 | |
| Protease | 1.265 | Ex Dupont |
| Termamyl Ultra (25.4 mg/g) | 0.120 | Ex Novozyme |
| Mannanase/Xylonase blend | 0.265 | Ex Novozyme |
| Lutensol FP 62 | 1.71 | Ex BASF |
| Sokalan PG101 Polymer | 3.38 | Ex BASF |
| Texcare SRA300 | 0.330 | Ex Clariant |
| Hydroxy Ethyl Di Phosphonic acid (HEDP) | 4.050 | Dequest 2010 ex Italmatch, Corporation Road, Newport South Wales Gwent NP19 4XF UK |
| Brightener 49 | 0.44 | |
| AF8017 suds suppressor | 0.200 | Ex Dow Corning |
| 1,2 PropaneDiol | 20.000 | |
| DPG (DiPropyleneGlycol) | 10.000 | |
| MEA (MonoEthanolAmine) | 6.5 | |
| K2SO3 | 0.376 | |
| MgCl2 | 0.333 | |
| Glycerol | 10.000 | |
| Perfume Oil | 2.000 | |
| Misc/water | To 100% | |

The above formulation is mixed and the final pH is adjusted into the range 7.50-8.00 using MEA or citric acid as appropriate. A mono-compartment detergent pouch is made through enclosing 25 g of detergent product between 2 water soluble polyvinyl alcohol films through thermo-vacuum forming.

Test Results:

The softness preference and actual grades from the expert panel tabulated below clearly show a softness benefit for the product in which no additional nonionic surfactant is added.

| Fabric | % Panelists Preference for test product B | % Panelists Preference for reference A | PSU Score |
|---|---|---|---|
| Black Cotton Towels | 7.4 | 92.6 | 2.31 (pref A) |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of washing a fabric, comprising the steps of:

a. obtaining a fabric comprising a softening active deposited thereon, wherein the softening active comprises a quaternary ammonium ester fabric softening active;

b. treating the fabric in a wash step, wherein the wash step comprises contacting the fabric with a wash liquor;

wherein the wash liquor is prepared by diluting a liquid laundry detergent composition, wherein the liquid laundry detergent composition is comprised in a water-soluble unit dose article comprising a water-soluble film, in water by between about 300 and about 800 fold and wherein the liquid laundry detergent composition comprises between about 0.02% and about 2% by weight of the liquid laundry detergent of a fatty alcohol ethoxylate non-ionic surfactant, wherein the fatty alcohol ethoxylate non-ionic surfactant comprises on average between about 12 and about 15 carbons in the alcohol carbon chain, and on average between about 7 and about 8 ethoxy units in the ethoxylation chain; and between about 20% and about 45% by weight of the liquid laundry detergent composition of non-soap anionic surfactant, wherein the non-soap anionic surfactant comprises linear alkylbenzene sulphonate and alkoxylated alkyl sulphate, and where the weight ratio of linear alkylbenzene sulphonate to alkoxylated alkyl sulphate is between about 2:1 and 1:1, wherein the weight ratio of non-soap anionic surfactant to fatty alcohol ethoxylate non-ionic surfactant is from about 5:1 to about 23:1, wherein the weight ratio of linear alkylbenzene sulphonate to fatty alcohol ethoxylate non-ionic surfactant is between about 2:1 to about 20:1, wherein the weight ratio of alkoxylated alkyl sulphate to fatty alcohol ethoxylate non-ionic surfactant is between about 2:1 and about 20:1, wherein the liquid laundry detergent composition comprises between about 0.5% and about 15% by weight of the liquid laundry detergent composition of water, and wherein the liquid laundry detergent composition comprises a polymer selected from the group consisting of alkoxylated polyethyleneimine, alkoxylated polyalkyl phenol, an amphiphilic graft copolymer, a polyester terephthalate, hydroxyethylcellulose, a carboxymethylcellulose, and mixtures thereof.

2. The process according to claim 1 comprising the step:

c. treating the fabric from step b in a rinse step, wherein the rinse step comprises contacting the fabric with a rinse solution;

wherein the rinse solution is prepared by diluting a fabric softening composition in water, wherein the fabric softening composition comprises a softening active.

3. The process according to claim 1, wherein the liquid laundry detergent composition comprises a second non-ionic surfactant selected from the group consisting of a fatty alcohol alkoxylate, an oxo-synthesised fatty alcohol alkoxylate, Guerbet alcohol alkoxylates, alkyl phenol alcohol alkoxylates, an alkyl polyglucoside (APG), and a mixture thereof.

4. The process according to claim 3, wherein the liquid laundry detergent composition comprises between about 0% and about 10% by weight of the liquid laundry detergent composition of the second non-ionic surfactant.

5. The process according to claim 1, wherein the liquid laundry detergent composition comprises alkoxylated alkyl sulphate, wherein the weight ratio of alkoxylated alkyl sulphate to total non-ionic surfactant is between about 2:1 and about 20:1, wherein total non-ionic surfactant is the sum total of weight percentage of the fatty alcohol ethoxylate non-ionic surfactant and the second non-ionic surfactant, if present.

6. The process according to claim 1, wherein the weight ratio of linear alkylbenzene sulphonate to total non-ionic surfactant is between about 2:1 to about 20:1, wherein total non-ionic surfactant is the sum total of weight percentage of the fatty alcohol ethoxylate non-ionic surfactant and the second non-ionic surfactant, if present.

7. The process according to claim 1, wherein the weight ratio of non-soap anionic surfactant to total non-ionic surfactant in the liquid laundry detergent composition is from about 5:1 to about 23:1, wherein the total non-ionic surfactant is the sum total of weight percentage of the fatty alcohol ethoxylate non-ionic surfactant and the second non-ionic surfactant, if present.

8. The process according to claim 1, wherein the liquid laundry detergent composition comprises between about 20% and about 60% by weight of the liquid laundry detergent composition of non-soap surfactant.

9. The process according to claim 1, wherein the liquid laundry detergent composition comprises between about 1% and about 20% by weight of the liquid laundry detergent composition of fatty acid, neutralised fatty acid soap, or a mixture thereof.

10. The process according to claim 1, wherein the polymer is selected from the group consisting of alkoxylated polyethyleneimine, an amphiphilic graft copolymer, a polyester terephthalate, and mixtures thereof.

11. The process according to claim 1, wherein the liquid laundry detergent composition comprises quaternized hydroxyethylcellulose, carboxymethylcellulose, or a mixture thereof.

12. The process according to claim 1, wherein the fabric is selected from cotton, polyester, cotton/polyester blends, or a mixture thereof.

* * * * *